United States Patent [19]

Bruning

[11] Patent Number: 4,722,294

[45] Date of Patent: Feb. 2, 1988

[54] V-BOTTOM PLANING BOAT WITH LIFTING RECESSES

[76] Inventor: Paul F. Bruning, 2515 Boulder Rd., Altadena, Calif. 91001

[21] Appl. No.: 858,822

[22] Filed: Apr. 29, 1986

Related U.S. Application Data

[63] Continuation of Ser. No. 335,101, Dec. 28, 1981, abandoned, which is a continuation-in-part of Ser. No. 967,693, Dec. 8, 1978, abandoned.

[51] Int. Cl.[4] ..... B63B 1/32

[52] U.S. Cl. ..... 114/290

[58] Field of Search ..... 114/56, 67 A, 61, 57, 114/288–290, 291–292, 355–358; 440/69, 70; 441/68

[56] References Cited

U.S. PATENT DOCUMENTS

| | | | |
|---|---|---|---|
| D. 160,027 | 9/1950 | Smith | 114/290 |
| D. 192,895 | 5/1962 | Dornak | 114/290 |
| 1,552,990 | 9/1925 | Hunt | 114/290 |
| 1,726,439 | 8/1929 | Kroukovsky | 114/290 |
| 2,938,490 | 5/1960 | Martin | 114/290 |
| 3,077,851 | 2/1963 | Bamberger | 114/62 |
| 3,117,544 | 1/1964 | Schoel | 114/291 |
| 3,148,652 | 9/1964 | Canazzi | 114/56 |
| 3,216,389 | 11/1965 | Thorsen | 114/62 |
| 3,330,237 | 7/1967 | Dornak | 114/56 |
| 3,428,979 | 2/1969 | Johnson | 441/68 |
| 3,791,329 | 2/1974 | Bruning | 114/61 |
| 3,930,455 | 1/1976 | Bremer | 114/290 |

FOREIGN PATENT DOCUMENTS

| | | | |
|---|---|---|---|
| 531545 | 1/1922 | France | 114/290 |
| 6712607 | 3/1969 | Netherlands | 114/291 |

*Primary Examiner*—Joseph F. Peters, Jr.
*Assistant Examiner*—Jesûs D. Sotelo
*Attorney, Agent, or Firm*—Christie, Parker & Hale

[57] ABSTRACT

A V-bottom planing hull has longitudinally elongate recesses formed in its bottom surface symmetrically of and parallel to the hull centerline. The recesses are open at the forward and aft ends and are concave downwardly of the hull. The recesses are semicircular in cross-section. The recesses provide lift to the hull as water moves through them during forward motion of the hull. The lift generated in the recesses augments conventional planing forces created by the hull, allowing the hull to move faster.

11 Claims, 7 Drawing Figures

V-BOTTOM PLANING BOAT WITH LIFTING RECESSES

CROSS-REFERENCE TO RELATED APPLICATIONS

This is a continuation of application Ser. No. 335,101 filed Dec. 28, 1981, now abandoned, which is a continuation-in-part of Ser. No. 967,693 filed Dec. 8, 1978, now abandoned.

BACKGROUND OF THE INVENTION

1. Field of the Invention

This invention pertains to boats and ships having planing hulls. More particularly, it pertains to V-bottom planing hulls having stabilizing recesses along their bottom surfaces which produce enhanced planing performance and improved stability in turns, among other benefits.

2. Review of the Prior Art

High speed motorboat hulls (such as are used for water skiing and racing) are increasingly of one or the other of two general planing types, namely, shallow V-bottom hullforms and tunnel hullforms. In a planing hull, the objective is to drive the hull across the surface of the water; the weight of the hull is supported by dynamic (motion-induced) forces applied to the hull by the water, not by buoyant forces due to immersion of the hull in the water. When a shallow V-bottom planing hull moves at high speed, the dynamic support forces act on a very small area of the hull along its centerline at its rear end; all other portions of the hull are out of the water. When a tunnel-type planing hull moves at high speed, the dynamic support forces act on small areas of the hull adjacent its rear end but spaced on opposite sides of the centerline.

V-bottom boats are much more popular than tunnel-hull boats for general use, water skiing and racing. Because of the different way that planing forces act on tunnel-hull boats, they have a much different "helm" (feel of the steering controls) than V-bottom boats at high speeds, and more skill and experience is required to operate a tunnel-hull boat at high speed than is the case with V-bottom hulls. However, tunnel-hull boats are considered safer at high speeds, if driven by a skilled operator, than V-bottom boats. A V-bottom boat turns more normally at high speed than a tunnel-hull boat; it tips more into the direction of the turn. On the other hand, a V-bottom boat tends to bounce substantially at high speed, regardless of the state of the water over which it moves. V-bottom boats are much more sensitive to chop of the water surface, and at high speeds they tend to fall off the center point of the V on which they are supported by the dynamic planing forces. In a turn at high speeds, a V-bottom boat slides or slips laterally, and thus makes a wide rather than a tight turn; this is a distinct disadvantage in racing. A tunnel-hull boat has better high speed performance characteristics than a V-bottom boat. A skilled operator would prefer a tunnel-hull boat over a V-bottom boat. But the great majority of boat owners do not desire very high performance and do not have the skill to safely operate a tunnel-hull boat.

My prior U.S. Pat. No. 3,653,609 describes, principally in the context of aircraft, a substantially cylindrical lifting surface arrangement in which the surface is downwardly-open and concave, and is aligned with the direction of flight and open at its forward and rear ends.

The surface is essentially free of camber along its length. As it moves through the air with a small angle of attack, air engages the surface. The surface has side edges, aligned with the length thereof, which extend downwardly relative to the middle of the surface. For example, if as preferred the surface has a semi-round arcuate transverse configuration, the side edges are disposed below the highest point of the arc a distance which is substantially equal to the radius of the arc so that the margins of the surface adjacent the side edges are substantially vertical. Air engaging the concave surface as it moves forward is kept in contact with the surface; the side edges of the surface prevent substantial lateral spill of air out of the concavity defined by the surface, so that substantially all of the air which enters the front end of the concavity leaves the vicinity of the surface through the open rear end of the concavity.

My prior U.S. Pat. No. 3,791,329 describes a boat, generally of the tunnel-hull type, in which two semi-cylindrical lifting surfaces, generally in accord with the teachings of U.S. Pat. No. 3,653,609, are provided, one along each side edge of the hull. U.S. Pat. No. 3,791,329 teaches that the lifting surfaces are located below all other downwardly facing hull surfaces, and so the hull surface between the lifting surfaces is located above the lifting surfaces.

When a hull of the type shown in U.S. Pat. No. 3,791,329 is propelled through the water, the lifting surfaces become effective, at surprisingly low speeds, to develop sufficient lift to raise the hull in the water until essentially only the lifting surfaces contact the water. Thereafter, the hull is supported on only the lifting surfaces at the water surface. The lifting surfaces cooperate with the water surface and do not rely upon submergence in the water as is the case with hydrofoils, but neither do the lifting surfaces function in a manner closely akin to water skis. They operate to produce lift but without the need for submergence. The tunnel-type hull, when driven at speeds substantially greater than the speed at which the lifting surfaces act to cause the hull to step out of the water onto the water surface, creates essentially no wake; the hull, in effect rides on two rails of water created by the lifting surfaces on the ambient water surface. The hull is therefore very fast and remarkably insensitive to chop on the surface of the water over which it moves. A need exists for similar improvements in V-bottom hulls which, as noted, are considerably more popular than tunnel-hulls.

SUMMARY OF THE INVENTION

This invention addresses and fills the need identified above. It provides improvements in V-bottom planing hulls. These improvements produce several desirable results and benefits. The invention results in a reduction of the speed at which the hull rises in the water and begins to plane. The invention reduces the tendency of a V-bottom hull to bounce and pitch at high speeds. The invention makes the hull less sensitive to the location of the center of mass of the hull and its contents at high speed. The planing speed of the hull for a given powering situation is increased. The pitch angle sensitivity of the hull is significantly reduced; pitch angle sensitivity is closely related to the tendency of a planing hull to flip over when encountering a wave or chop at high speed. The invention enhances the stability of the hull in a turn and significantly reduces the turning radius for a given speed. An overall result of the invention is to safely give to the average operator of a V-bottom boat the benefits of tunnel-hull performance over a wide range of speeds, including low speeds, without requiring the operator to possess the level of skill needed to safely operate a tunnel-hull boat.

Generally speaking, this invention resides in a boat which comprises a hull having bow and stern ends and a longitudinal centerline about which the hull is essentially symmetrical. The hull has a bottom surface of shallow V configuration. The hull bottom surface has at least one elongate, downwardly facing recess formed therein symmetrically relative to and parallel to the centerline. Each recess opens to the hull stern and extends therefrom along the hull toward the bow, over a distance which is a substantial portion of the length of the hull, to an open forward end of the recess. Each recess comprises a downwardly open concave face, which extends along the length of the recess. Each reces also has side edges on the concave face, the side edges extending downwardly a sufficient distance below the middle of the concave face for inhibiting substantial flow of water laterally from the recess.

DESCRIPTION OF THE DRAWINGS

The above-mentioned and other features of this invention are more fully set forth in the following detailed description of presently preferred and other embodiments of the invention, which description is presented with reference to the accompanying drawings, wherein.

DESCRIPTION OF THE ILLUSTRATED EMBODIMENTS

Figure 1:
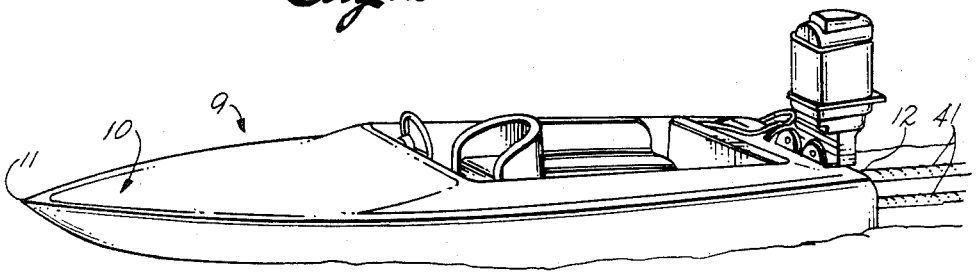
FIG. 1 is a perspective view of a planing boat according to this invention.
Figure 5:
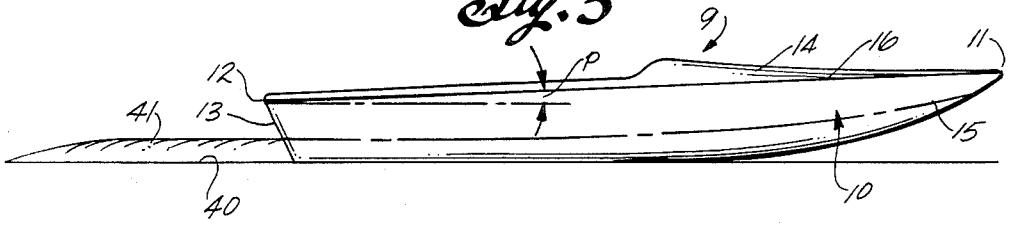
FIG. 5 is an elevation view representing the attitude and relation of the boat to the ambient water surface during planing operation of the boat.
Figure 2:
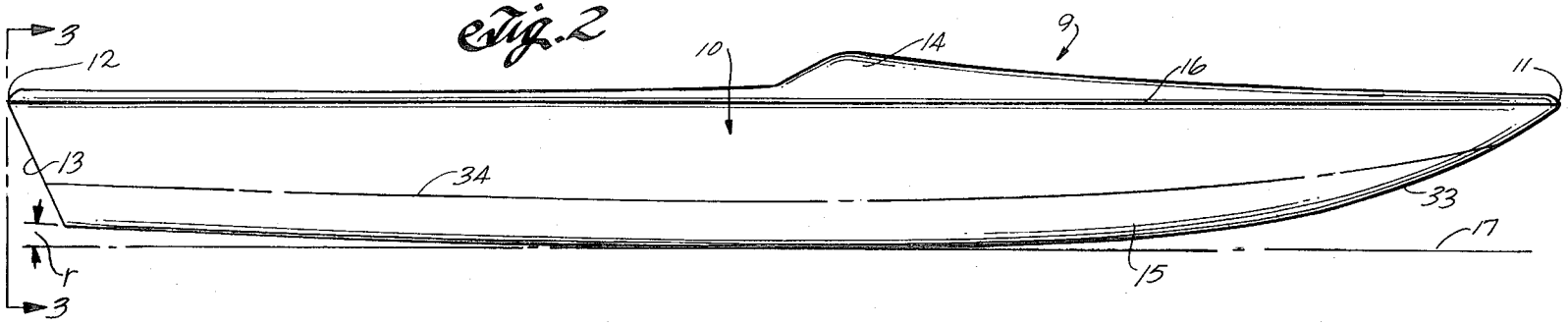
FIG. 2 is a side elevation view of the boat shown in FIG. 1.

FIGS. 1–5 illustrate a presently preferred planing boat 9 according to this invention. The boat has a hull 10 having bow and stern ends 11 and 12, the stern of the boat being defined by a rearwardly raked transom 13. The boat is adapted at and adjacent its stern to receive a suitable propulsion mechanism, such as an outboard motor as shown in FIG. 1. The hull preferably is made of fiberglass-reinforced plastic and, accordingly, is fabricated in an upper part 14 and a lower part 15 which are joined together at a parting line 16 which preferably is defined in a common plane. As shown in FIG. 2, the hull has associated with it a design base plane (line) 17 which is established, by design convention, parallel to parting plane 16.

As can be seen from the elevation view of FIG. 2, hull 10 has maximum depth (distance between parting plane 16 and base plane 17) at a location intermediate the length of the boat. FIG. 2 is an even-keel elevation view of the boat and shows that the keel of the boat (the portion of hull bottom surface 18 which lies along a longitudinal center plane 19 of the hull) manifests negative rake between the location of maximum hull depth and the stern of the boat. That is, at its stern the hull is of lesser depth than at a location forwardly from the stern. The negative rake of hull 10 is expressed in FIG. 2 by rake angle r. Between the stern and the location of maximum hull depth, the rake angle is substantially constant, i.e., the keel between the location of maximum hull depth and the stern is essentially straight. In the presently preferred boat shown essentially to scale in FIG. 2, rake angle r has a value of from about 1.0° to about 2.5° and preferably has a value of about 1.5°.

Hull aft keel rake angle r is a design characteristic of hull 10, not necessarily an operating characteristic. That is, rake angle r is discerned in the actual hull when the hull is floating at rest in an even-keel attitude, i.e., with parting plane 16 horizontal. As noted below, the rake angle r disappears during planing operation of the boat as the hull rises by the bow from its at-rest attitude.

Figure 3:
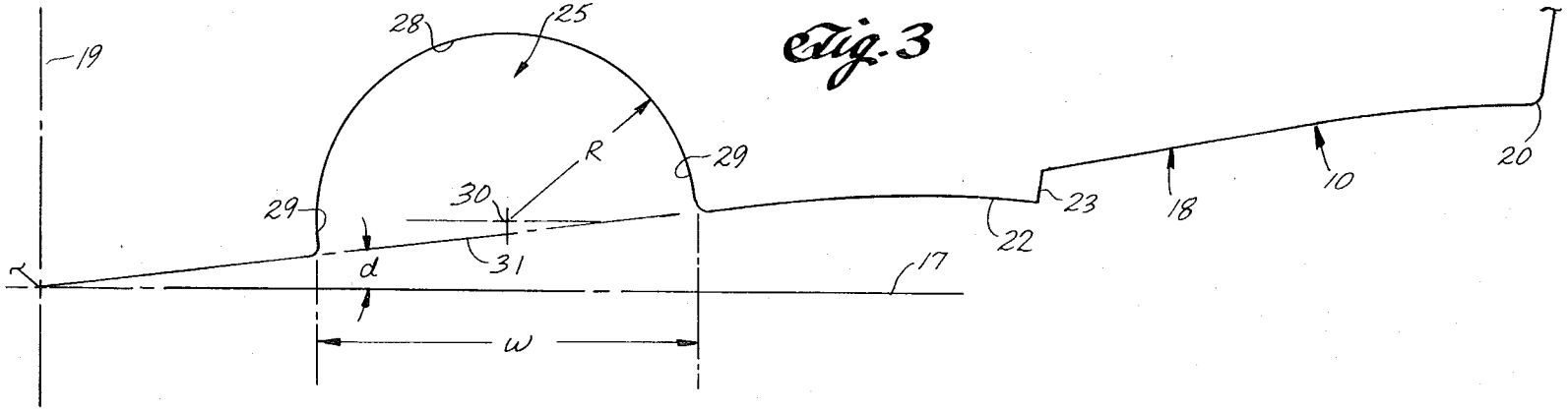
FIG. 3 is an enlarged fragmentary end elevation view taken along line 3—3 in FIG. 2.

FIG. 3 is an enlarged fragmentary end elevation view of hull 10. FIG. 3 shows the line of intersection of hull bottom surface 18 with transom 13 on the right (starboard) half of the hull between hull center plane 19 and a beam chine 20 of the hull. As shown in FIG. 3, hull 10 has a bottom surface 18 which is of shallow V configurtion. That is, the bottom surface 18 of the hull does not lie in the base plane 17 of the hull, but instead departs upwardly from the base plane proceeding from the hull center plane to the beam chine in an essentially linearly progressive manner. Such deviation of the hull bottom surface from the base plane is known as "deadrise", the angle of which for hull 10 is represented by angle d in FIG. 3. The deadrise angle for a boat according to this invention, is in the range of from about 8° to about 18°, and preferably is about 12°. At a location about two-thirds of the way outboard from center plane 19 toward beam chine 20, hull bottom surface 18 is configured to define a strake 22 which depends from the otherwise substantially flat, shallowly inclined bottom surface. Strake 22 defines an outwardly facing surface 23 which is substantially parallel to center plane 19 along the extent of the strake.

Figure 4:
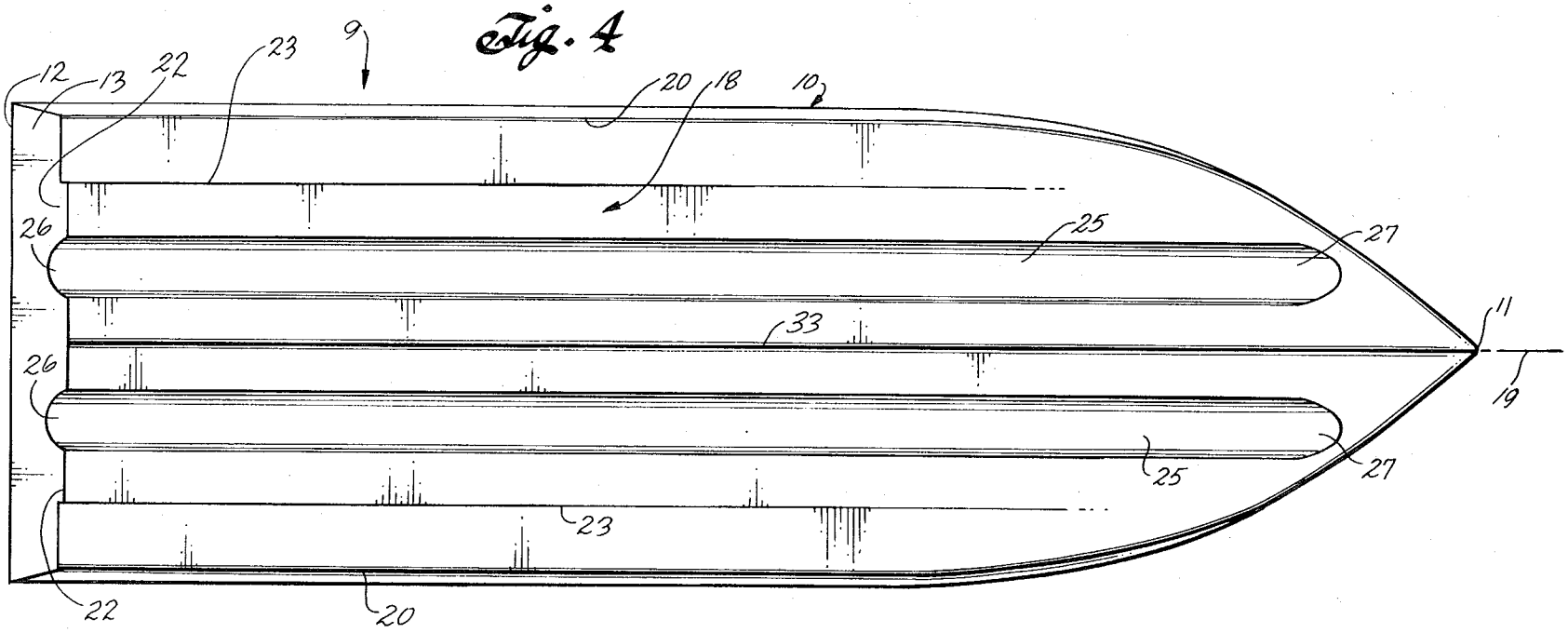
FIG. 4 is a bottom plan view of the boat shown in FIGS. 1 and 2.

Hull 10 is distinguished by the presence in its bottom surface 18 of a pair of elongate recesses 25 disposed in the hull symmetrically about and parallel to center plane 19. Each recess has an open rear end 26 to the transom of the hull and an open forward end 27 (see FIG. 4). Each recess extends forwardly from the transom along the hull toward the bow of the hull over a distance which is a substantial portion of the length of the hull. As shown in FIG. 4, grooves 25 have lengths which are about 90 percent of the overall length of the hull. Each recess comprises a downwardly-open concave face 28 (see FIG. 3) which extends along the length of the recess. Each recess also includes substantially parallel side edges 29 on each concave face, the side edges extending downwardly a sufficient distance beyond (i.e., below) the middle of the concave face for inhibiting substantial flow of water laterally from the recesses during operation of the boat.

As shown in FIG. 3, it is preferred that each recess 25 be of semicircular configuration when viewed in a plane transverse to the length of the recess; FIG. 3 is essentially such a view. When viewed in transverse cross-section, each recess has a radius of curvature R from a center of curvature 30. The recess center of curvature, at essentially all points along the length of the recess (save for the portion of the recess immediately adjacent to its forward end where the depth of the recess decreases as the recess fairs into the hull bottom surface), is located either in or very close to an extension 31 of hull bottom surface 18 across the open lower portion of each recess. As shown in FIG. 3 as to recess 25 at its rear end, the recess transverse center of curvature 30 is located slightly above the extension 31 of the hull bottom surface across the recess. This relationship between the recess transverse center of curvature and the bottom surface extension 31 assures that the side edges 29 of concave face 28 are essentially vertical and each side edge intersects the hull deadrise line at substantially a right angle as shown in detail in FIG. 3. Each side edge 29 preferably departs from a true vertical orientation in the hull only by an amount essentially equal to the deadrise angle at the location where the side edge 29 intersects the hull bottom surface.

The preferred semicircular recess configuration assures adherence to certain relationships which should be observed in the practice of this invention. It is not essential that the transverse configuration of each recess 25 be semicircular; such configuration can be elliptical or any other configuration desired so long as the relationship $w \leqq 2R$ is substantially observed. In this relationship, w is the width of the reess transversely of its elongate extent, as represented in FIG. 3, and R is the effective depth of the recess which preferably occurs at about the middle of its width at any point along its length. Where a semicircular transverse recess configuration is provided, then $w=2R$. It will be appreciated that the relationship $w \leqq 2R$ is a general relationship, and that recesses having a width slightly greater than twice the depth R of the recess are operative but not as effective as those recesses which conform to this relationship.

Upon review of my prior U.S. Pat. Nos. 3,653,609 and 3,791,329, it will be seen that recesses 25 are similar to the lifting surfaces there described in the context of aircraft and tunnel-hull boats, respectively.

I prefer to use a recess 25 which has constant cross-sectional area and configuration along substantially the entirety of its length, except at and adjacent the forward end of the recess where the recess decreases in depth and in width as the recess fairs into the curvature of the hull bottom surface.

Inasmuch as this invention pertains to a V-bottom planing boat, it will be appreciated that the hull keel line 33 has gradually increasing positive rake forward of the location of maximum hull depth, and that the deadrise angle may gradually increase proceeding forwardly from about the location of the maximum depth of the hull which, as noted, is about amidships in boat 9. The gradual reduction in the depth of each recess at its forward end is shown in FIG. 2 by line 34 which represents the line through the uppermost points of the starboard recess 25 at each increment of its length. It is therefore seen that line 34 is parallel to the hull keel line along the greatest portion of the length of the recess at and forwardly from transom 13.

FIG. 2 is drawn essentially to scale with respect to the curvatures of keel line 33 and of line 34 relative to the length of the boat. In other words, the portions of FIG. 2 below hull parting line 16 are accurately drawn to scale pursuant to measurements taken directly from the hull of a boat having a 16 foot length overall. FIG. 3 was prepared from a full-scale tracing of the line of intersection of the hull bottom surface and with transom 13 between the center plane and the beam chine of the same boat, a distance of about $32\frac{3}{4}$ inches. Recesses 25 in this boat have a radius of $4\frac{1}{8}$ inches. The recesses are of uniform depth for a distance of about 12 feet forwardly from transom 13 and are centered about $9\frac{7}{8}$ inches on either side of the hull longitudinal center plane.

The factors and variables pertinent to the operation of planing hulls are discussed in *Hydrodynamics in Ship Design,* by Harold E. Saunders, Society of Naval Architects and Marine Engineers, 1957, at Chapter 13 (Vol I, pgs. 204–208), at Chapter 30 (Vol. I, pgs. 422–432), and at Chapter 53 (Vol. II, pgs. 263–273). The effects of running trim angle, deadrise angle, wetted surface area, lift coefficient $C_L$ and other factors and their relation to each other are considered.

A planing boat comparable to boat 9 but having no recesses 25 is a typical V-bottom planing boat. When operating at high speed, it runs with a trim angle p (see FIG. 5) and contacts the water surface in a triangular area centered on centerline 19 adjacent the vessel stern. The boat in effect runs on a single central aft point of suspension. At such high speeds, it is apparent that the typical V-bottom planing boat is very sensitive to the lateral and longitudinal positions of boat center of gravity. The boat readily tips off its single point of suspension if the boat center of gravity becomes unbalanced (misaligned) with the center of dynamic lift forces applied to the boat. That is, at high speeds (say 40 mph or more) a typical V-bottom planing boat becomes unstable and gives a rough ride.

In boat 9, wherein recesses 25 are present, dramatic advantages over the comparable typical V-bottom boat are encountered. Boat 9 "steps out" of the water and begins to plane at much lower speeds, even as low as about 7 mph. Once boat 9 has begun to plane, it moves faster for a given level of applied driving power and at a lower value of trim angle; that is, the boat having the longitudinally recessed bottom has lower planing resistance. Boat 9 can be driven to speeds of about 75 mph without becoming unstable, and it is much less sensitive to chop on the water surface and makes a tighter turn than the comparable V-bottom boat having no recesses 25. These advantages are due to the effect of recesses 25.

As the boat moves ahead at any speed, the water in the recesses is prevented from spilling laterally therefrom by the side edges 29 of recess concave faces 28. The dynamic lift effects on the hull of water in the recesses are maximized, and so the boat "steps up" faster to a planing condition from a non-planing condition. The recesses extend over a substantial length of the boat and are always filled with water (even when the boat is planing at very high speed), and so the lift forces during planing act on the hull over a greater fore-and-aft distance than otherwise. This renders the boat less sensitive to trim angle variation and to the longitudinal position of the center of gravity. Because the recesses are spaced on either side of the center plane of boat 9, the boat is less sensitive to changes in lateral position of the center of gravity and is laterally stable, especially in turns. The recesses are essentially always full of water regardless of how fast the boat is driven and how high it rides on the water surface because there is always some slight action or chop on the water surface to cause the recesses to be filled over at least the rearmost 4 to 5 feet of their length.

At very high speeds, boat 9 rides very high on water surface 40 with a trim angle p which is equal to or greater than aft keel rake angle r. As a practical matter, running trim angle p (a dynamic property of the boat) is slightly greater than the keel rake angle r (a static design property of the boat) because recesses 25, in order that they function as lifting surfaces, have a small angle of attack relative to the ambient water surface 40. When the 16 foot boat referred to above is driven at 50 mph, strake 22 is visible over the entire length of the boat. At all planing conditions, hull 10 appears to run on two rails of water in that the water which enters recesses 25 stays in the recesses and leaves them through the open rear ends of the recesses to define two mounds or rails 41 of water on top of the ambient water surface 40 (see FIG. 5). These rails are discernible on the ambient water surface for some distance aft of the planing boat. Also, the boat generates substantially no spray wake when planing. The "water rail" effect is believed to contribute to the substantial reduction in the turning radius of boat 9 as compared to a comparable typical V-bottom boat at equal speeds.

The overall effect of recesses 25 in boat 9 is to give to the boat stability and planing performance characteristics more like or superior to those encountered in tunnel-hull planing boats, but without any appreciable change in the level of skill required to safely operate the boat. Recesses 25 produce tunnel-hull performance at low speeds in a V-bottom boat for the benefit of the average boater, and without encountering the significant trim angle sensitivity to which a typical tunnel-hull boat is subject.

Figure 6:
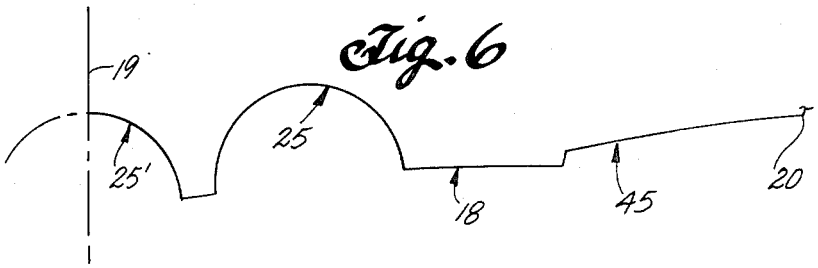
FIG. 6 is a view similar to that of FIG. 3 of another planing boat.

FIG. 6 is a view, similar to the view of FIG. 3, of an aft portion of a boat 45 in which the hull bottom surface 18 defines three recesses, namely, two recesses 25 and a single recess 25'. Recesses 25 of boat 45 are identical to the recesses formed in the bottom surface of boat 9 and therefore bear the same reference character. Recess 25' is essentially identical to each of recesses 25 except that it is centered on the longitudinal center plane 19 of boat 45. The additional recess provides added lifting and hull supporting capacity. In all other respects, boats 45 and 9 have very similar performance characteristics.

Figure 7:
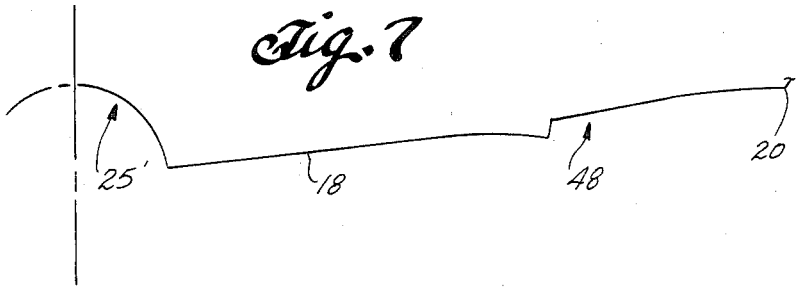
FIG. 7 is a view similar to FIG. 3 of yet another planing boat.

FIG. 7 is a view, similar to that of FIG. 6, of an aft portion of another boat 48 in which the hull bottom surface 18 defines only a single recess 25' located along the longitudinal center plane 19. As compared to boat 9, boat 48 does not "step out" of the water to a planing state as rapidly as boat 9 and, when planing at a given speed, would not ride as high in the water. Boat 48 would have substantially the same turning characteristics as boat 9 and about the same degree of sensitivity to the position of the longitudinal center of gravity. On the other hand, because recess 25' is located only along the vessel's centerline, as compared to locations straddling the centerline, boat 48 would have about the same degree of sensitivity to lateral center of gravity as a comparable conventional V-bottom planing boat.

The arrangement shown in FIGS. 1–5 is the form of the invention which I presently prefer.

The foregoing description has been presented with reference to a presently preferred embodiment of this invention and to other forms thereof. These descriptions have been presented by way of example and illustration; they have not been intended as an exhaustive catalog of all forms and arrangements in which the benefits of this invention may be achieved. Workers skilled in the art to which this invention pertains will appreciate that variations or modifications of the arrangements described above may be practiced while adhering to the principles of this invention. Accordingly, the foregoing description should not be considered as limiting the scope of this invention.

What is claimed:

1. A boat comprising a hull having bow and stern ends and a longitudinal vertical centerplane about which the hull is essentially symmetrical, the hull having a bottom surface of shallow V configuration of selected deadrise angle, the hull bottom surface having a plurality of elongate, downwardly facing recesses formed therein symmetrically relative to and parallel to the centerplane over its entire length, each recess opening to the hull stern and extending therefrom along the hull toward the bow over a distance which is a substantial portion of the length of the hull to an open forward end of the recess, all recesses being disposed in the hull bottom surface within substantially the central one-half of the extent of the bottom surface transversely of the centerplane and being of substantially constant cross-sectional area over a substantial portion of their lengths from the hull stern and forwardly thereof along the hull, each recess comprising a downwardly open arcuately curved concave face extending along the length of the recess, and side edges on each concave face extending downwardly a sufficient distance beyond the middle of the concave face along a substantial portion of the length of the recess from the stern forwardly thereof for inhibiting substantial flow of water laterally from the recess, and in which the side edges of each concave face intersect the hull bottom surface at substantially a right angle which does not deviate from a true 90° angle to the bottom surface by an amount greater than the deadrise angle.

2. A boat according to claim 1 wherein each recess, in cross-section transversely of the length thereof, is essentially semicircular.

3. A boat according to claim 1 wherein the hull bottom surface defines a pair of said recesses, one on each side of the centerplane.

4. A boat according to claim 1 wherein the hull bottom surface defines one of said recesses along the centerplane thereof.

5. A boat according to claim 1 wherein each recess over a substantial portion of its length at and adjacent the rear end thereof is substantially straight.

6. A boat according to claim 1 wherein the portion of the length of each recess in which the recess is of substantially constant cross-sectional area is a major portion of the length of the recess.

7. A boat according to claim 1 wherein the deadrise angle is in the range of from 8° to about 18°.

8. A boat comprising a hull having bow and stern ends and a longitudinal vertical centerplane about which the hull is essentially symmetrical, the hull having between beam chines a bottom surface of shallow V configuration of selected deadrise angle, the hull bottom surface, inwardly toward the centerplane from the beam chines, having a plurality of elongate, downwardly facing recesses formed therein symmetrically relative to and parallel to the centerplane over their entire lengths, each recess opening to the hull stern and extending therefrom along the hull toward the bow over a distance which is a substantial portion of the length of the hull to an open forward end of the recess, all recesses being disposed in the hull bottom surface within substantially the central one half of the extent of the bottom surface transversely of the centerplane and being of substantially constant cross-sectional area over a substantial portion of their lengths from the hull stern end forwardly thereof along the hull, each recess comprising a downwardly open arcuately curved concave face extending along the length of the recess, and side edges on each concave face extending downwardly a sufficient distance beyond the middle of the concave face along a substantial portion of the length of the recess from the stern forwardly thereof for inhibiting substantial flow of water laterally from the recess, and in which the side edges of each concave face are disposed substantially normal to said bottom surface within limits of normality not greater than the deadrise angle.

9. A boat according to claim 8 wherein the hull bottom surface defines one of said recesses along the centerplane.

10. A boat according to claim 8 wherein the deadrise angle is about 12°.

11. A boat comprising a hull having bow and stern ends and a longitudinal vertical centerplane about which the hull is essentially symmetrical, the hull having a bottom surface of shallow V configuration of selected deadrise angle, the hull bottom surface having a single elongate, downwardly facing recess formed therein symmetrically relative to and parallel to the centerplane over its entire length, the recess opening to the hull stern and extending therefrom along the hull toward the bow over a distance which is a substantial portion of the length of the hull to an open forward end of the recess, the recess being of substantially constant cross-sectional area over a substantial portion of its length from the hull stern and forwardly thereof along the hull, the recess comprising a downwardly open arcuately curved concave face extending along the length of the recess, and side edges of each concave face extending downwardly a sufficient distance beyond the middle of the concave face along a substantial portion of the length of the recess from the stern forwardly thereof for inhibiting substantial flow of water laterally from the recess, and in which the side edges of each concave face intersect the hull bottom surface at substantially a right angle which does not deviate from a true 90° angle to the bottom by an amount greater than the deadrise angle.

* * * * *